US006840064B2

(12) United States Patent
Okamoto

(10) Patent No.: US 6,840,064 B2
(45) Date of Patent: Jan. 11, 2005

(54) CYLINDRICAL KNITTING FABRIC SOUND WITH DEPTH FORMED AND METHOD OF KNITTING IT

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/477,949

(22) PCT Filed: Apr. 26, 2002

(86) PCT No.: PCT/JP02/04298

§ 371 (c)(1),
(2), (4) Date: Nov. 18, 2003

(87) PCT Pub. No.: WO02/097179

PCT Pub. Date: Dec. 5, 2002

(65) Prior Publication Data

US 2004/0154344 A1 Aug. 12, 2004

(30) Foreign Application Priority Data

May 25, 2001 (JP) ..... 2001-157985

(51) Int. Cl.[7] ..... D04B 7/10
(52) U.S. Cl. ..... 66/70; 66/170
(58) Field of Search ..... 66/61, 75.1, 60 R, 66/70, 71, 76, 77, 73, 67, 169 R, 170–177

(56) References Cited

U.S. PATENT DOCUMENTS 5,253,492 A * 10/1993 Mitsumoto ..... 66/69
5,577,398 A * 11/1996 Jeffcoat ..... 66/64
5,669,244 A * 9/1997 Okuno ..... 66/64
5,722,262 A * 3/1998 Proctor et al. ..... 66/60 R
5,749,247 A 5/1998 Jeffcoat
5,836,177 A 11/1998 Caird et al.
6,109,068 A 8/2000 Rempp et al.
6,216,494 B1 4/2001 Essig et al.
6,318,131 B1 * 11/2001 Kobata et al. ..... 66/64

FOREIGN PATENT DOCUMENTS

| | | |
|---|---|---|
| GB | 962358 | 7/1964 |
| JP | 61-20667 | 5/1986 |
| JP | 3-75656 | 12/1991 |
| JP | 7-70886 | 3/1995 |
| WO | 00/28121 | 5/2000 |
| WO | 01/88243 | 11/2001 |

* cited by examiner

*Primary Examiner*—Danny Worrell
(74) *Attorney, Agent, or Firm*—Wenderoth, Lind & Ponack, L.L.P.

(57) ABSTRACT

Stitches of front and back knitted fabrics are overlapped with each other and bound off in the regions located on both the outermost right and left sides in a knitting width at the terminal end of the tubular knitted fabric in which the front and back knitted fabrics are continuous to each other. In addition, the stitches of the adjacent regions in the front and back knitted fabrics, in which the stitches of the front and back knitted fabrics are overlapped with each other and bound off between the regions, also overlapped with each other and bound off.

7 Claims, 9 Drawing Sheets

CYLINDRICAL KNITTING FABRIC SOUND WITH DEPTH FORMED AND METHOD OF KNITTING IT

TECHNICAL FIELD

The present invention relates to a tubular knitted fabric in which front and back knitted fabrics are continuously joined to each other at both ends thereof by a flat knitting machine and in which depth is formed between the front and back knitted fabrics at the terminal end of the knitted fabric, and to a method of knitting the tubular knitted fabric.

BACKGROUND ART

A knitted fabric, in which one end of a tubular knitted fabric is joined as shown in FIG. 9 can be knitted. The knitted fabric is formed as a tubular knitted fabric whose front and back knitted fabric portions are continuously joined to each other at both ends thereof. The stitches of the final courses of the front and back knitted fabrics, which are held to needle beds that confront each other, back and forth, at the terminal ends thereof are laid on any one of the needle beds so as to form new stitches thereat. The new stitches are bound off from one end to the other thereof, so that the tubular knitted fabric whose one end is joined can be knitted.

However, in the tubular knitted fabric whose one end is joined by the above method, since the front and back knitted fabrics are simply bound off by overlapping the loops of the confronting final courses thereof, the loops of the final courses of the front and back knitted fabrics are only overlapped with each other and no depth (i.e., no space) is formed in the final end portion of the joined knitted fabric.

An object of the present invention is to provide a tubular knitted fabric in which a depth portion is formed and joined thereto on the side thereof where knitting is ended, and a method of knitting the tubular knitted fabric.

SUMMARY OF THE INVENTION

To achieve the above object, a tubular knitted fabric of the present invention has a depth (i.e., closed portion) formed and joined thereto, and is knitted by a flat knitting machine having at least a pair of front and back needle beds each slidably accommodating knitting needles. The stitches of front and back knitted fabrics are overlapped with each other and bound off in the regions located on both the outermost right and left sides (i.e., outermost opposite sides) in a knitting width at the tubular opening (i.e., an end) of a tubular portion of the tubular knitted fabric in which the front and back knitted fabrics are continuous to each other. The stitches of the adjacent regions in the front and back knitted fabrics in the opening region other than the above region, in which the stitches of the front and back knitted fabrics are overlapped with each other and bound off, are overlapped with each other, bound off, and closed, so that lines are formed radially in the closed (bottom) portion thereof by the binding-off.

A method of knitting a tubular knitted fabric of the present invention includes closing a tubular opening of a tubular portion knitted as the tubular knitted fabric in which a front knitted fabric is continuous to a back knitted fabric at both sides thereof by a flat knitting machine having at least a pair of front and back needle beds, each slidably accommodating knitting needles. The final course of a tubular knitted fabric held to front and back needle beds is divided into a plurality of regions, the stitches of front and back knitted fabric that confront in front and back in the regions located on the right and left (i.e., opposite) outermost sides of the divided regions are overlapped with each other, and the overlapped stitches are bound off. The stitches of the adjacent regions in the front and back knitted fabrics in the opening region located between the regions on the outermost right and left sides, which are bound off at the above step, are overlapped with each other and the overlapped stitches are bound off.

Further, one characteristic of the present invention resides in that the overlapping of the stitches of the front and back knitted fabrics with each other and binding off of the overlapped stitches comprises a step of repeating knitting for transferring the stitches of the front knitted fabric nearest to the side end thereof from a front needle bed to a back needle bed at one end of the tubular knitted fabric in the knitting width thereof, and transferring the stitches of the back knitted fabric nearest to the side end thereof from the back needle bed to the front needle bed at the other end of the tubular knitted fabric so that the respective regions to be joined of the knitted fabrics are shifted to the positions of the front and back needle beds at which the respective regions confront each other. Thereafter, the stitches held to the knitting needles of the needle beds that confront each other are overlapped in front and back, and the overlapped stitches are bound off.

Further, another characteristic of the present invention resides in that a knitted portion is formed by flechage knitting by reversing a yarn feed direction in mid course of the knitted region of the tubular knitted fabric, and by using the knitting needles of a part of the knitted region subsequent to knitting of a tubular shape. The loops of the final courses of the flechage-knitted portion are also coupled with each other.

DETAILED DESCRIPTION OF THE INVENTION

An embodiment of a tubular knitted fabric in which a depth portion (i.e., closed portion) is formed, and a method of knitting the tubular knitted fabric according to the present invention will be explained below based on the drawings.

First, a knitting machine used in the present invention is a flat knitting machine having at least a pair of front and back needle beds. Each needle bed accommodates knitting needles arranged so that they can slidingly advance and retract with the front and back needle beds, and is needle plated so as to move relatively right and left.

EXAMPLE 1

Figures 1A, 1B, 1C, 1D, 1E:
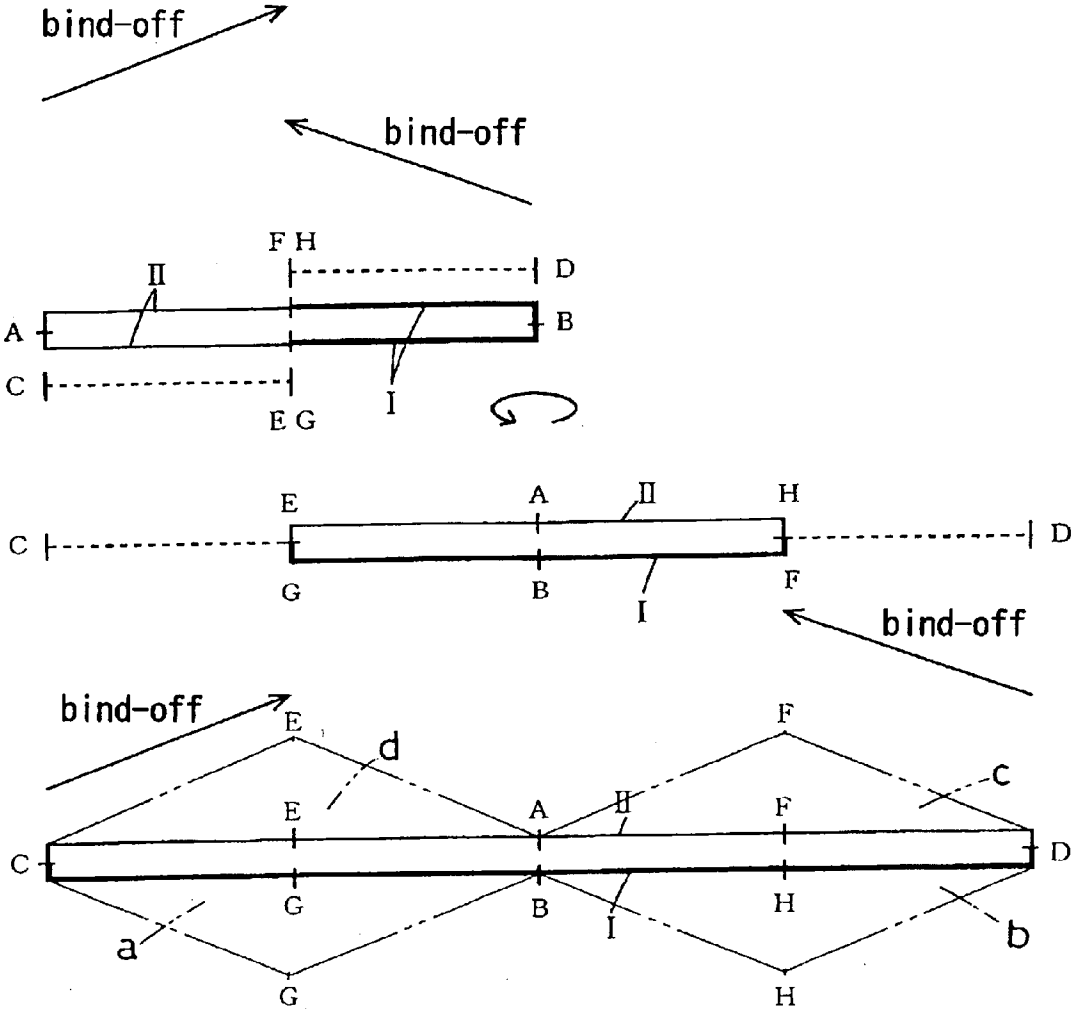
FIGS. 1(*a*) to 1(*e*) are views for explaining knitting processes of a tubular knitted fabric according to a first example.
Figure 3B:
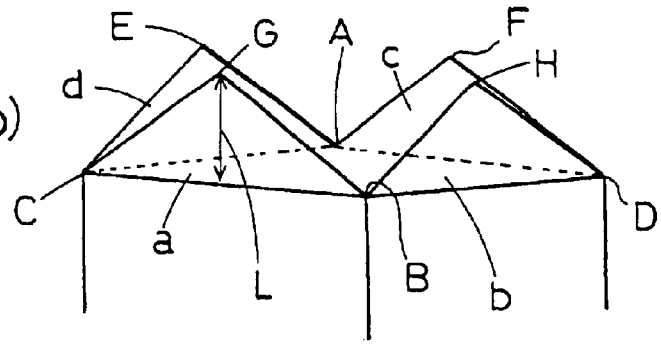
FIGS. 3(*a*) and 3(*b*) are perspective views of the knitted fabrics in the knitting process of the tubular knitted fabric according to the first example.
Figure 3A:
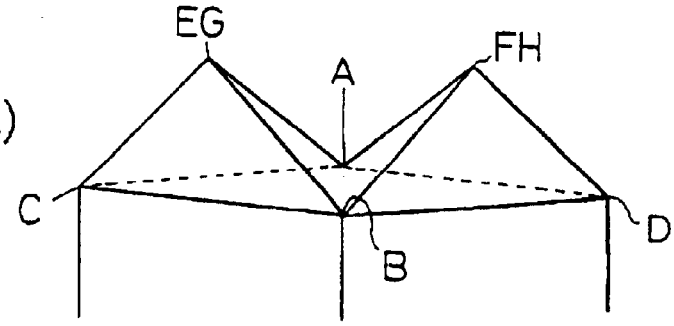
Figure 5:
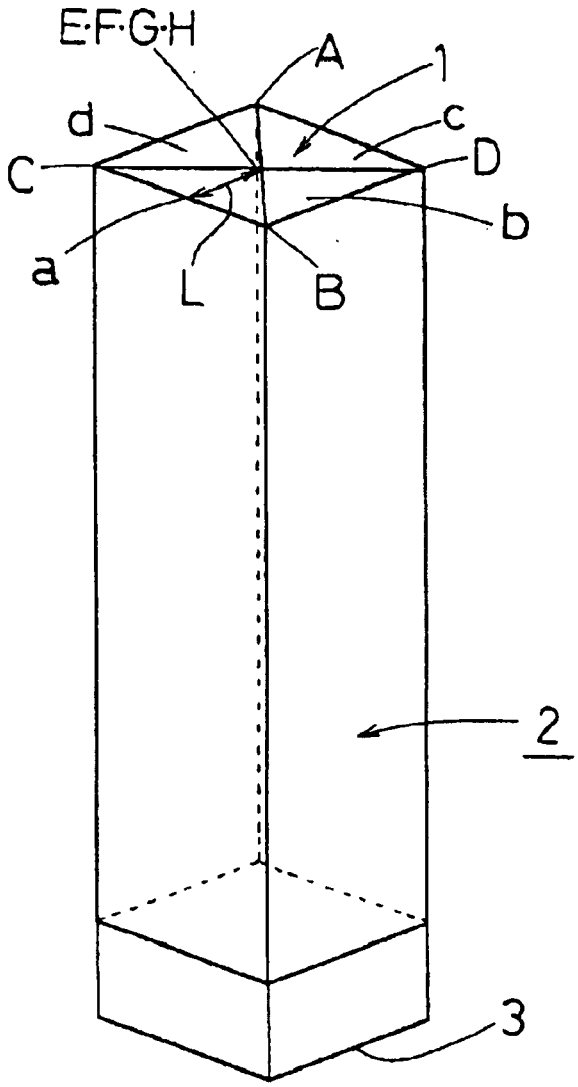
FIG. 5 is a perspective view of the tubular knitted fabric according to the first example.

FIGS. 1(*a*) to 1(*e*) and FIGS. 3(*a*) to 3(*b*) show an example in which a tubular cover (tubular portion) 2 having a bottom portion (i.e., closed portion) 1 is formed as an example of a tubular knitted fabric having a depth formed thereto and joined as shown in FIG. 5, and FIG. 1(*a*) shows the terminal end portion of the tubular knitted fabric shown in FIG. 5. In FIG. 1(*a*), reference numeral I (thick line portion) and reference numeral II show knitted fabric portions held to the knitting needles of the front needle bed or to the knitting needles of the back needle bed, respectively.

Then, these front and back knitted fabrics I and II are coupled with each other at both right and left end portions C and D, and isosceles-triangular knitted fabrics a, b, c, and d are formed on the front and back knitted fabrics I and II to form a bottom portion as shown in FIG. 3(*a*).

Of these isosceles-triangular knitted fabrics a, b, c, d for forming the bottom portion, the knitted fabrics a and b are each formed as an isosceles-triangle by flechage knitting using knitted fabrics C–B and B–D held to the knitting needles of the front needle bed as bases, and the knitted fabrics d and c are each formed as an isosceles-triangle by flechage knitting using knitted fabrics C–A and A–D held to the knitting needles of the back needle bed as bases, respectively. The number of stitches h1 to the apexes E, F, G, H of these isosceles-triangles is one-half the number of stitches between confronting sides of a rectangle shown in FIG. 5 (that is, it is the same number as the number of stitches to the center of a tube).

Next, the outside oblique surface portions of the respective isosceles-triangles that confront each other in front and back (CE and CG, and DF and DH) are overlapped with each other and bound off from the outside stitches to the inside stitches as shown in FIG. 1(*b*) using, for example, the binding-off method previously invented by the applicant and disclosed in Japanese Patent No. 3044368.

With the above operation, a state shown in FIG. 3(*b*) and FIG. 1(*c*) is obtained, and the bound-off portions are removed from the knitting needles. It is needless to say that the binding-off method is by no means limited to the method disclosed in the above patent publication.

Figures 2A, 2B, 2C:
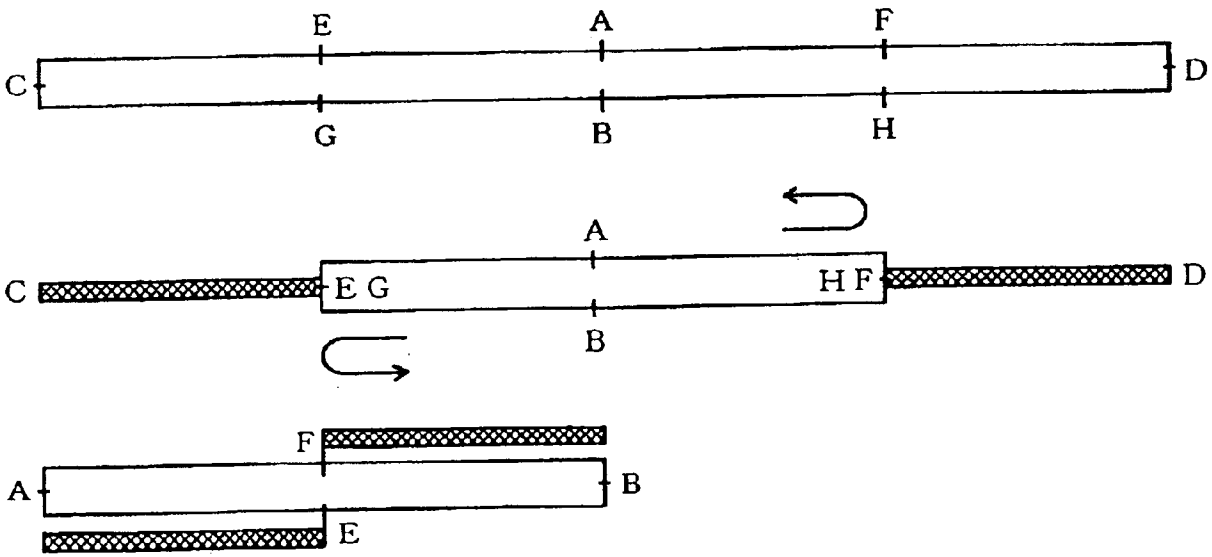
FIGS. 2(*a*) to 2(*c*) are plan views of knitted fabrics in the knitting process of the tubular knitted fabric according to the first example.

Thereafter, the knitted fabrics held to the knitting needles of the front and back needle beds are shifted from a state shown in FIG. 1(*c*) to a state shown in FIG. 1(*d*) and FIG. 2(*c*). This shift is executed by, for example, sequentially shifting the stitches of the front needle bed to the back needle bed from the right end thereof at the right end of the tubular knitted fabric while moving the back needle bed left, and, in parallel (conjunction) with the above shift, by sequentially shifting the stitches of the back needle bed to the front needle bed from the left end thereof at the left end of the tubular knitted fabric while moving the back needle bed left.

The knitted fabrics shifted to the state of FIGS. 1(*d*) and 2(*c*) are in a state as if they are turned. Next, when oblique surface portions (AE and AF, and BG and BH) are overlapped with each other and bound off from the outside stitches to the inside stitches using the binding-off method invented by the applicant and disclosed in Japanese Patent No. 3044368 as shown in FIG. 1(*e*) and as mentioned above, a tubular cover (tubular portion) 2, which has a bottom portion 1 which provides depth, is formed as shown in FIG. 5.

Figure 6:
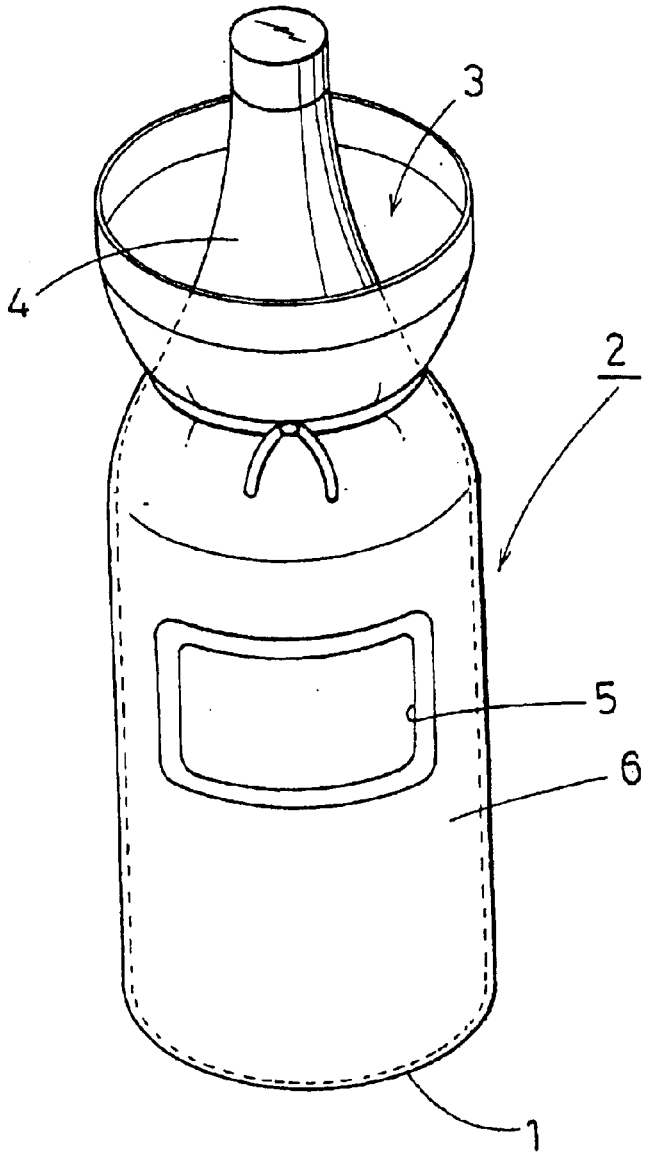
FIG. 6 is a perspective view of the tubular knitted fabric according to the first example when it is used.

Reference numeral 5 in FIG. 6 denotes a window formed on a side wall portion of the tubular cover 2.

Figures 4A, 4B, 4C, 4D:
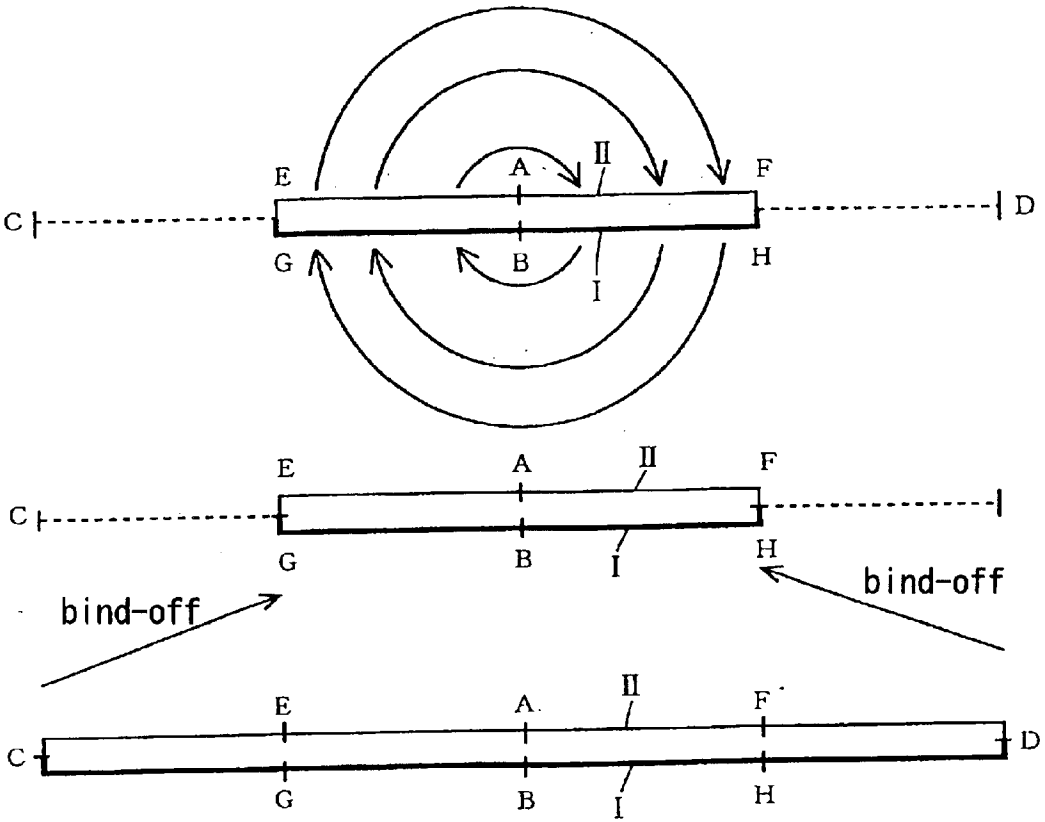
FIGS. 4(*a*) to 4(*d*) are views explaining a modified example of the coupling of stitches in the knitting process of the tubular knitted fabric according to the first example.

Note that although the knitted fabrics held to the knitting needles of the front and back needle beds are shifted from the state of FIG. 1(*c*) to the state of FIG. 1(*d*) and FIG. 2(*c*), oblique surface portions may be coupled with each other as shown in FIG. 4(*d*), in place of the above shift.

A method of coupling the oblique surface portions with each other as shown in FIGS. 4(*a*) to 4(*d*) is such that steps executed in FIGS. 4(*a*) to 4(*c*) are the same as the step executed in FIG. 1(*d*) of the above embodiment. In a step executed in FIG. 4(*d*), the adjacent stitches of the oblique surface portions (AE and AF, and BG and BH) held to the knitting needles of the front and back needle beds are coupled with each other by the method proposed by the applicant previously and disclosed in WO01/88243.

In the method disclosed in WO01/88243, the stitches between B and H of the front knitted fabric are transferred from a state shown in FIG. 4(*c*) to the empty needles on the back needle bed, and the stitches between E and A of the back knitted fabric are transferred to the empty knitting needles on the front needle bed. Then, stitches are newly formed by sequentially overlapping the stitches, which have been shifted onto the back needle bed, of the knitted fabric BH with the stitches at the right end between B and G of the above knitted fabric on the front needle bed from the stitches of the knitted fabric BH at the left end thereof while moving the back needle bed. In addition, loops are newly formed by overlapping the loops between A and E of the back knitted fabric with the stitches at the left end between A and F of the back knitted fabric on the back needle bed from the loop at the right end between A and E of the back knitted fabric. When the above knitting is repeated, the BG and BH portions of the front knitted fabric and the AE and AF portions of the back knitted fabric are bound off such that the stitches near to points A and B are overlapped with each other and the stitches far from the points A and B are overlapped with each other. According to the method disclosed in WO01/88243, yarn cut due to the wear of yarn fibers can be prevented because stitch transfer of the same loop need not be repeatedly executed between the front and back needle beds to execute the binding-off. However, when only a small number of loops are required, the binding-off method is by no means limited to the method disclosed in WO01/88243, and any method may be employed as long as it can join the BG and BH portions of the front knitted fabric to each other and the AE and AF portions of the back knitted fabric to each other such that the stitches near to each other and the stitches far from each other are overlapped with each other, respectively, with respect to the points A and B.

A bottle 4 such as a wine bottle or the like is inserted into the tubular cover 2 formed as described above from an article charging port 3 formed of a knitting start portion as shown in FIG. 6. The bottle 4 is accommodated in the tubular cover 2 while fitted to the bottom portion 1 thereof which forms the depth.

EXAMPLE 2

Figures 7A, 7B, 7C, 7D, 7E, 7F, 7G, 7H:
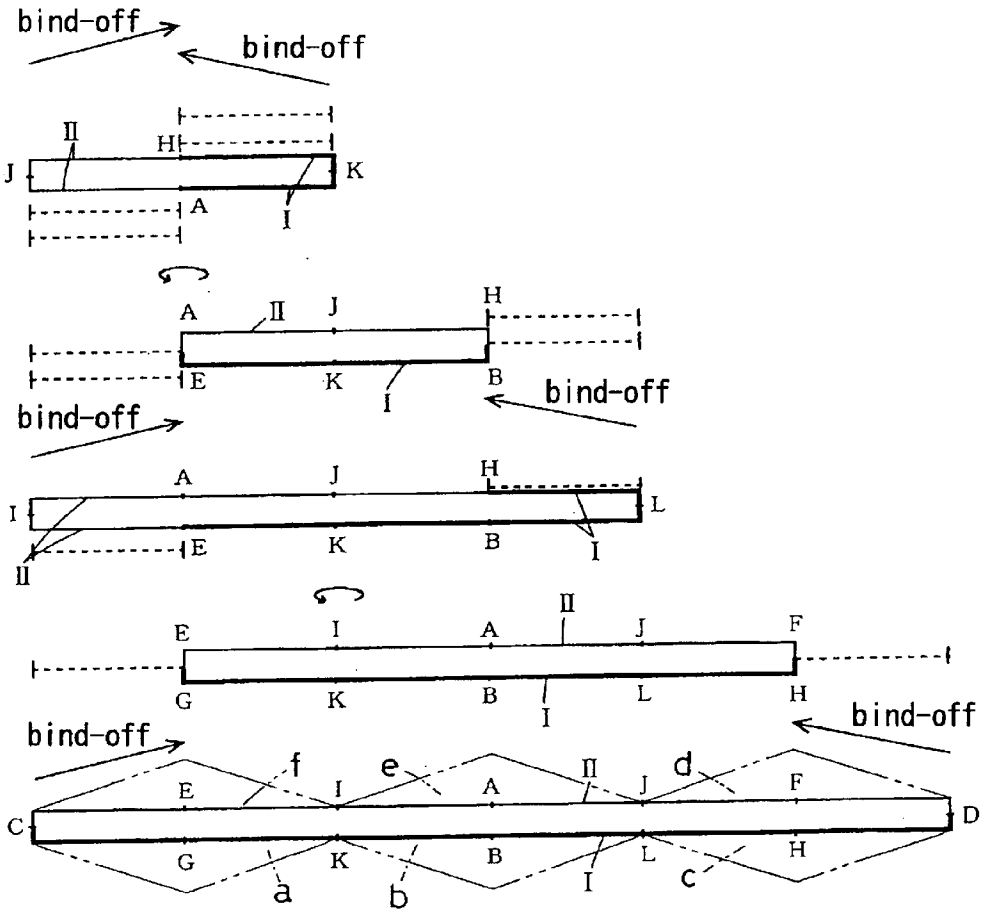
FIGS. 7(*a*) to 7(*h*) are views explaining knitting processes of a tubular knitted fabric according to a second example.
Figure 8:
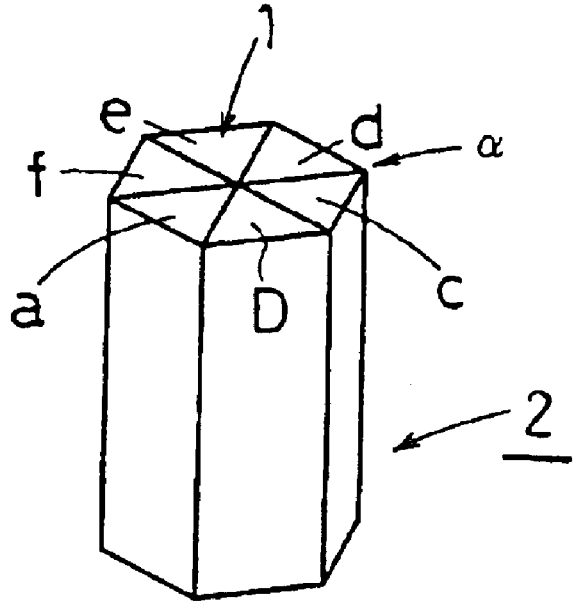
FIG. 8 is a perspective view of the tubular knitted fabric according to the second example.
Figure 9:
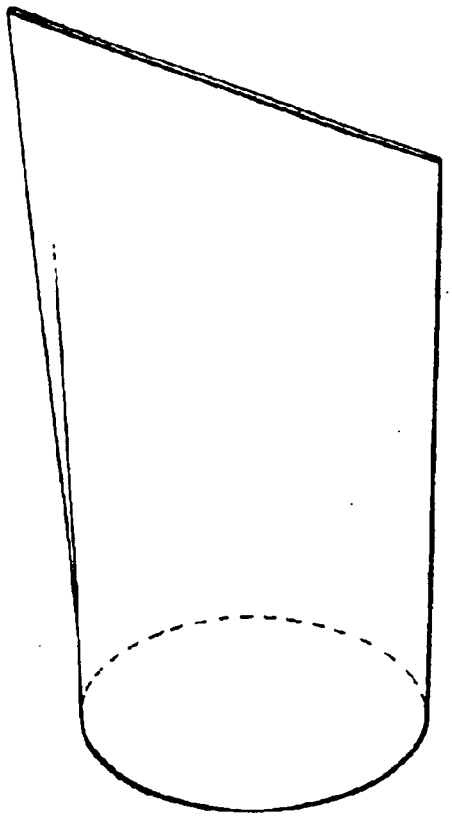
PRIOR ART Fig.9
FIG. 9 is a perspective view of a tubular knitted fabric according to a conventional example.

This example employs a hexagonal bottom portion 1 as shown by α in FIG. 8 in place of the bottom 1 in the above example. When the hexagonal bottom shown in FIG. 8 is formed, each three front and back isosceles-triangular knitted fabrics a, b, c, d, e, f having apexes G, B, H, E, A, F are formed to front and back knitted fabrics I and II coupled with each other at both ends C and D by flechage knitting in a state shown in FIG. 7(*a*).

The number of stitches h1 to the apexes G, B, H, E, A, F is the same as the number of stitches to the center of a tube in the state α in FIG. 8.

Next, the outside oblique surface portions of the respective isosceles-triangles that confront each other in front and back (CE and CG, and DF and DH) are overlapped with each other and bound off as shown in FIG. 7(*b*) using the binding-off method previously invented by the applicant and disclosed in Japanese Patent No. 3044368, and the stitches of these portions are removed from the knitting needles (refer to FIG. 7(*c*)).

Thereafter, the knitted fabrics I and II held to the knitting needles of the front and back needle beds are shifted from a state shown in FIG. 7(*c*) to a state shown in FIG. 7(*d*) by sequentially shifting the stitches of the front needle bed to the back needle bed from the right end thereof at the right end of a tubular knitted fabric while moving the back needle bed left. In parallel (conjunction) with the above shift, the stitches of the back needle bed are sequentially shifted to the front needle bed from the left end thereof at the left end of the tubular knitted fabric as described in the above example 1. As a result, the knitted fabrics shifted to the state of FIG. 7(*d*) are in a state as if they are turned.

Then, the outside oblique surface portions of the respective isosceles-triangles that confront each other in front and back (IA and IE, and LB and LH) are overlapped with each other again and bound off as shown in FIG. 7(*e*), and the stitches of these portions are removed from the knitting needles (refer to FIG. 7(*f*)).

Further, the stitches of the front needle bed are sequentially transferred to the back needle bed from the end thereof while moving the back needle bed so that the knitted fabrics are shifted to the state shown in FIG. 7(*g*), and then the oblique surface portions (JA and JH, and KH and KA) are overlapped with each other and bound off from the outside stitches to the inside stitches thereof as shown in FIG. 7(*h*) by the same binding-off method as that described above. As a result, a tubular cover 2 having a hexagonal bottom 1 as shown by α of FIG. 8 is formed.

As described above, according to the knitting method of the embodiments, in the terminal end portion of the tubular knitted fabric, the loop of the front knitted fabric is overlapped with the loop of the back knitted fabric and bound off in the regions located on both the outermost right and left sides. Then, the stitches of the front knitted fabric and the stitches of the back knitted fabric in the adjacent regions in the region located between the region in which the stitches of the front and back knitted fabrics are overlapped with each other and bound off. Thus, the terminal end portion of the tubular knitted fabric can be joined through the bottom portion formed thereto.

Note that although the above embodiments describe the case in which the binding-off is executed after the triangular flechage knitted portions are formed in the terminal end portion, the present invention is not limited to forming the triangular portions by the flechage knitting described above. Although it is possible to form the bottom portion flat by forming the triangular portions, the object of providing the depth can be achieved without forming the triangular portions.

When stretch yarns are used when the binding-off is executed, a joined portion can be made inconspicuous because the knitted fabrics are attracted to each other at the joined portion.

Further, when the bottom portion is divided into six sections or more, after the knitted fabrics are turned laterally as shown in and after FIG. 7(*c*), a knitting operation is repeated as many times as the number of portions to be divided to execute the binding-off.

In addition to the above-mentioned arrangement, although the knitted portion in the terminal end portion of the tubular knitted fabric is formed of isosceles-triangles, it is also possible to form the terminal end portion of scalene triangles. In addition, the tubular knitted fabric according to the present invention is not limited to accommodating an article, and it is needless to say that it can form a knit product such as a hat.

Industrial Applicability

As described above, according to the present invention, when a tubular knitted fabric, which has front and back knitted fabrics continuous to each other at both sides thereof, is knitted by a flat knitting machine having at least a pair of front and back needle beds each slidably accommodating knitting needles, the stitches of the front and back knitted fabrics are overlapped with each other and bound off at both the right and left (opposite) sides thereof in a width direction in the terminal end portion of the tubular knitted fabric. The stitches of the front knitted fabric and the stitches of the back knitted fabric in the adjacent regions in the region located between the region in which the stitches of the front and back knitted fabrics are overlapped with each other and bound off, are also overlapped and bound off. Thus, the tubular knitted fabric having the depth formed thereto can be formed.

What is claimed is:

1. A tubular knitted fabric comprising:

a front knitted fabric;

a back knitted fabric continuously stitched to said front knitted fabric along both opposite sides of said front knitted fabric and said back knitted fabric so as to form a tubular portion; and a closed portion at an end of said tubular portion, said closed portion being formed of stitches of said front knitted fabric and said back knitted fabric that are overlapped and bound off at outermost opposite side regions of said end of said tubular portion, and formed of stitches of said front knitted fabric and said back knitted fabric that are overlapped, bound off, and closed at remaining adjacent regions of said end of said tubular portion other than said outermost opposite side regions so that radial lines are formed in said closed portion extending from the center of said closed portion due to said binding off of said stitches.

2. The tubular knitted fabric of claim 1, wherein said closed portion has a substantially rectangular shape and includes four radial lines extending from the center of said closed portion.

3. The tubular knitted fabric of claim 1, wherein said closed portion has a substantially hexagonal shape and includes six radial lines extending from the center of said closed portion.

4. The tubular knitted fabric of claim 1, wherein said closed portion is formed by a flat knitting machine having at least a pair of front and back needle beds each slidably accommodating knitting needles.

5. A method of knitting a tubular fabric, comprising:

continuously stitching a front knitted fabric to a back knitted fabric along both opposite sides of the front knitted fabric and the back knitted fabric so as to form a tubular portion;

closing a tubular opening at an end of the tubular portion using a flat knitting machine having at least a pair of front and back needle beds each slidably accommodating knitting needles so as to form a closed portion at said end, said closing including:

dividing a final course of the tubular portion held by the front and back needle beds into a plurality of regions including outermost opposite side regions at the end of the tubular portion and adjacent regions at the end of the tubular portion located between the outermost opposite side regions;

overlapping stitches of the front knitted fabric and the back knitted fabric that confront each other in the outermost opposite side regions;

binding off the overlapped stitches in the outermost opposite side regions;

overlapping stitches of the front knitted fabric and the back knitted fabric that confront each other in the adjacent regions; and binding off the overlapped stitches in the adjacent regions.

6. The method of claim 5, wherein said overlapping of stitches in the adjacent regions and said binding off of the overlapped stitches in the adjacent regions comprises:

transferring the stitches of the front knitted fabric nearest to a side end thereof from the front needle bed to the back needle bed at a first end of the tubular portion, and transferring the stitches of the back knitted fabric nearest to a side end thereof from the back needle bed to the front needle bed at a second end of the tubular portion, so as to thereby shift respective positions of regions of the tubular portion to be joined so that the regions of the tubular portion to be joined are positioned on the front and back needle beds so as to confront each other;

overlapping the stitches of the regions of the tubular portion to be joined that are held by the front and back needle beds so as to confront each other; and binding off the overlapped stitches.

7. The method of claim 5, wherein said closing of the tubular opening at the end of the tubular portion includes forming the closed portion by flechage knitting by reversing a yarn feed direction in mid-course of a knitting region, by using the knitting needles of a part of the knitting region subsequent to knitting of the tubular portion, and by coupling loops of final courses of the flechage-knitted portion with each other.

* * * * *